US007226227B2

(12) United States Patent
Gueret

(10) Patent No.: US 7,226,227 B2
(45) Date of Patent: Jun. 5, 2007

(54) DEVICE FOR PACKAGING AND DISPENSING A SUBSTANCE, IN PARTICULAR A COSMETIC

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 120 days.

(21) Appl. No.: 10/620,809

(22) Filed: Jul. 17, 2003

(65) Prior Publication Data

US 2004/0052568 A1 Mar. 18, 2004

Related U.S. Application Data

(60) Provisional application No. 60/410,304, filed on Sep. 13, 2002.

(30) Foreign Application Priority Data

Jul. 17, 2002 (FR) ..... 02 09060

(51) Int. Cl.
*B43K 27/02* (2006.01)

(52) U.S. Cl. ..... 401/18; 401/17; 401/23; 401/183; 401/202; 401/126; 401/190; 401/98; 132/317

(58) Field of Classification Search ..... 401/16–18, 401/23–26, 57, 183–186, 202, 207, 98, 126, 401/190; 132/317
See application file for complete search history.

(56) References Cited

U.S. PATENT DOCUMENTS 460,602 A * 10/1891 Stevens ..... 401/17
2,215,161 A * 9/1940 Sapery ..... 132/314
4,807,773 A 2/1989 Tsai
5,655,554 A 8/1997 Goldberg
5,765,407 A * 6/1998 Choo et al. ..... 68/214
5,897,262 A * 4/1999 Bratby-Carey ..... 401/18
6,276,853 B1 * 8/2001 Breidenbach et al. ..... 401/34
6,334,727 B1 1/2002 Gueret
6,363,947 B1 * 4/2002 Wu ..... 132/297
6,866,437 B2 3/2005 Gueret
2004/0190974 A1 9/2004 Cantone et al.

FOREIGN PATENT DOCUMENTS

FR 2617024 A1 12/1988
GB 2297535 A 8/1996
JP 36-24129 2/1958
JP 35-11354 5/1960
JP 56-72730 6/1981
JP 60-5620 1/1985

(Continued)

*Primary Examiner*—David J. Walczak
(74) *Attorney, Agent, or Firm*—Oliff & Berridge, PLC

(57) ABSTRACT

A packaging and dispenser device may include: a receptacle containing a first substance; an application surface secured to the receptacle during application of the first substance; and a closure capsule configured to be removably fixed on the receptacle. The closure capsule may be configured to enable the closure capsule to be fixed on the receptacle. The packaging and dispenser device may also include at least one housing containing a second substance, the housing being suitable for opening from an end of the capsule remote from a part of the closure capsule configured to enable the closure capsule to be fixed on the receptacle, so that the second substance in the housing may be removed.

64 Claims, 6 Drawing Sheets

FOREIGN PATENT DOCUMENTS

| | | |
|---|---|---|
| JP | 60-30718 | 3/1985 |
| JP | 60-139712 | 9/1985 |
| JP | 60-179218 | 11/1985 |
| JP | 61-10122 | 1/1986 |
| JP | 3-41611 | 4/1991 |
| JP | 6-7609 | 2/1994 |
| JP | 08318949 | 12/1996 |
| JP | 11-508154 | 7/1999 |
| JP | 2002-85152 | 3/2002 |

* cited by examiner

Fig. 8
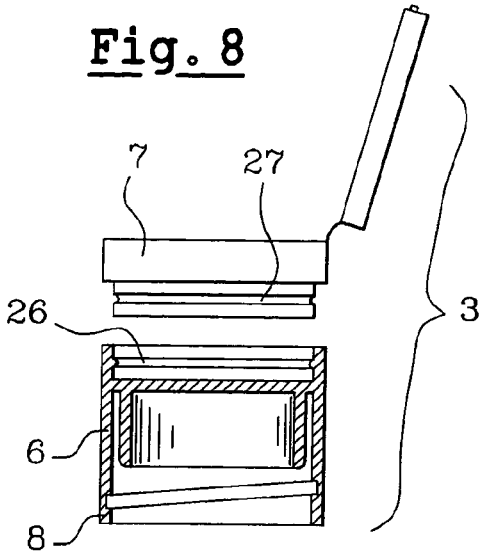
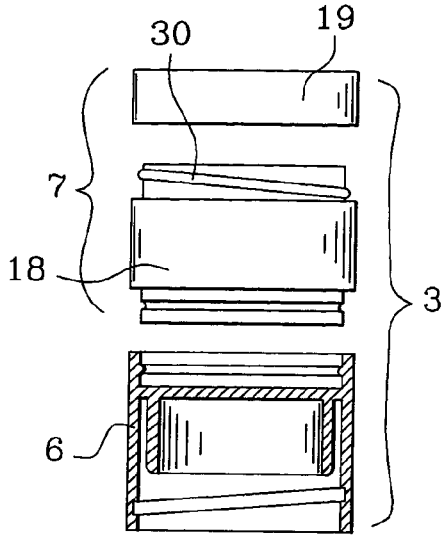
Fig. 9
Fig. 10
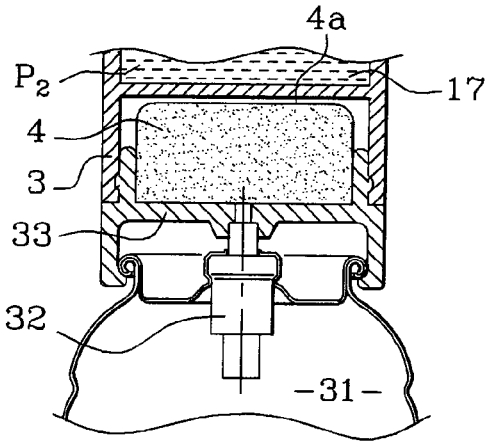
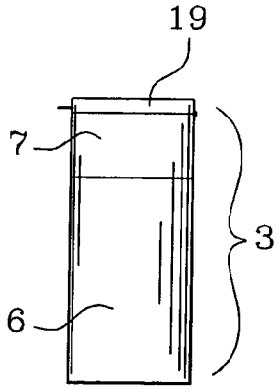
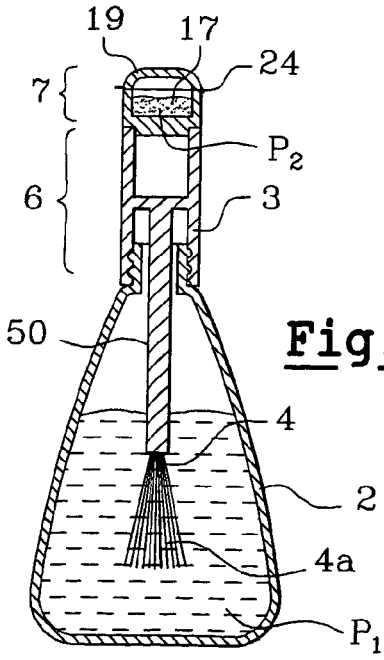
Fig. 11
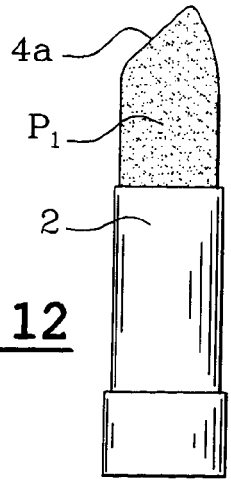
Fig. 12

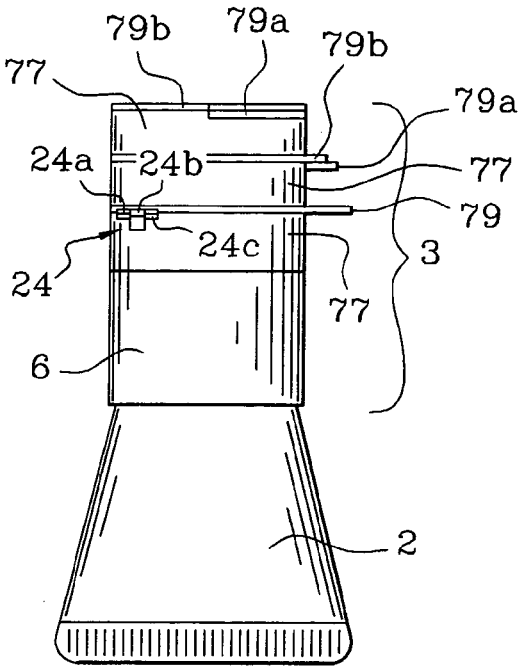
Fig. 26
Fig. 27
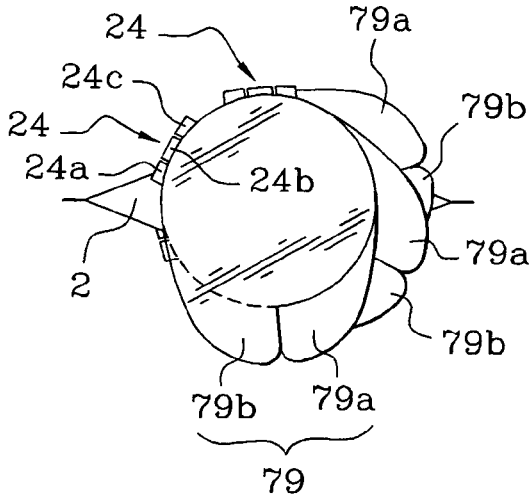
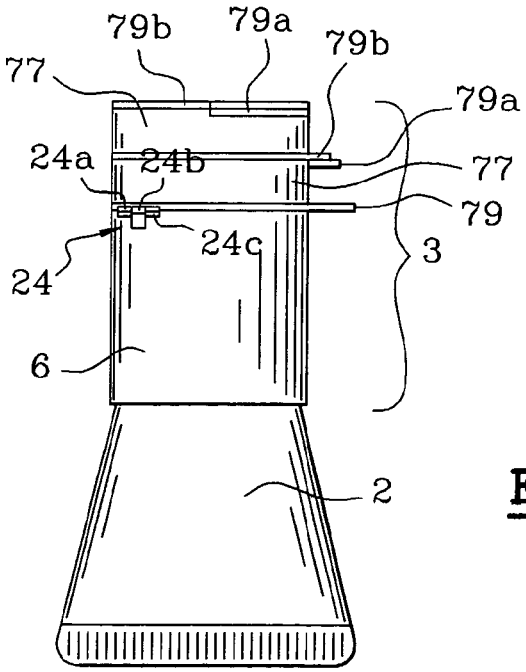
Fig. 28

DEVICE FOR PACKAGING AND DISPENSING A SUBSTANCE, IN PARTICULAR A COSMETIC

CROSS REFERENCE TO RELATED APPLICATION

The present application claims the benefit of French patent application number 02-09060, filed Jul. 17, 2002 and U.S. Provisional patent application No. 60/410,304, filed Sep. 13, 2002, the disclosures of which are hereby incorporated by reference.

BACKGROUND OF THE INVENTION (i) Field of the Invention

The present invention relates to devices for packaging and dispensing at least one substance, and in particular a cosmetic or a care product.

(ii) Description of Related Art

The term "cosmetic" is used herein to mean a cosmetic product as defined in EEC Council Directive 93/35 of Jun. 14, 1993.

French patent application FR-A-2 805 720 discloses packaging and dispenser devices comprising a receptacle containing a substance and an applicator member disposed on the receptacle in such a way as to be fed with the substance contained therein. By way of example the applicator member can be constituted by an open-celled foam through which the substance coming from the receptacle passes and whose surface is used for applying the substance, e.g. on the skin.

Such devices cannot be fully adapted to applying a substance that contains solid bodies of relatively large size, e.g. flakes, since such bodies are liable to be retained within the applicator member and fail to reach the surface used for application purposes.

European patent application EP-A-1 044 625 discloses an applicator assembly comprising a receptacle fitted with an applicator member containing a first substance. That receptacle is fitted with a capsule including a second substance in the form of a solid cake or a powder. The second substance can come into contact with the applicator member when the capsule is fixed on the receptacle.

With such an applicator assembly, it can be difficult for the user to determine the quantity of the second substance that is picked up by the applicator member.

In addition, the second substance contained in the capsule is in contact with ambient air when the capsule is removed, and that can lead to a problem of conservation, particularly when the second substance contains at least one volatile solvent.

SUMMARY AND OBJECTS OF THE INVENTION

There exists a need to benefit from a packaging and dispenser device that remedies the above-mentioned drawbacks in full or in part.

In one of its aspects, the invention provides a packaging and dispenser device capable of satisfying this need and comprising:

a receptacle containing a first substance;

an application surface secured to the receptacle during application, said application surface enabling the first substance to be transferred onto the surface to be treated, for example the skin, the lips, the nails, the eyelashes, or the eyebrows; and a closure capsule configured to be removably fixed on the receptacle, said closure capsule comprising:

fixing means for enabling the closure capsule to be fixed on the receptacle; and at least one housing containing a second substance, said housing being suitable for opening from an end of the capsule remote from the fixing means in order to make it possible to take the second substance present in the housing.

The closure capsule may close the receptacle containing the first substance;

The housing may be defined by an optionally removable portion of the closure capsule.

With such a device, it is possible to apply makeup by depositing solid bodies, for example, on the skin which would not be able to reach the application surface starting from the receptacle, said solid bodies being constituted, for example, by flakes, this being done by placing the solid bodies in the housing and taking them from the housing prior to applying them with the application surface.

In addition, it is possible to configure a capsule in such a manner that the housing is capable of being closed in substantially leakproof manner even when the capsule is removed, thus enabling the substance contained therein to be properly conserved.

By way of example, the fixing means may comprise a thread, a portion in relief for performing snap-fastening, e.g. an annular groove or bead, or indeed a portion for co-operating with the receptacle by friction.

The fixing means may comprises an assembly skirt defining a space inside the skirt that is configured to enable the receptacle to be engaged therein, at least in part.

The fixing means may be configured to enable the receptacle, preferably a housing containing the first substance, to be closed in leaktight manner, when the closure capsule is in place. The closure capsule may be configured to isolate from the outside the application surface, when the closure capsule is in place on the receptacle.

In another of its aspects, the invention also provides a packaging and dispenser device comprising:

a receptacle containing a first substance;

a closure capsule configured to be fixed in removable manner on the receptacle;

an application surface suitable for being contained in the assembly formed by the receptacle and the closure capsule when the receptacle is closed by the closure capsule, said application surface optionally being secured to the receptacle; and at least one housing defined by a removable portion of the capsule, said removable portion being capable of being fixed on a base portion of the capsule, the closure capsule being configured to enable the housing to be opened independently of fixing the removable portion on the base portion, the housing being suitable for containing at least part of an applicator member and/or a second substance.

The first substance may be a cosmetic or a care product, which may be solid or liquid, for example.

By way of example, the first substance may be in the form of a solid block forming a cake or a stick, and the application surface may be constituted by at least a portion of the surface of said block. The first substance may be for treating or making up the lips or the skin, for example.

When the substance is in liquid or powder form, the application surface may still be defined by a first applicator member, e.g. fixed on the receptacle and fed with substance by the receptacle, or configured to take substance by being inserted into the receptacle.

The first applicator member may be engaged at least in part in an inside space of the closure capsule when the capsule closes the receptacle.

The first applicator member may present a surface state and a variety of shapes, and the application surface may be generally outwardly convex in shape, for example.

The first applicator member may be porous.

By way of example, it may comprise a foam having cells that are open or closed.

It may be compressible, for example comprising an elastically deformable material such as a foam of polyurethane, of polyester, of polyether, of polyvinyl chloride (PVC), of nitrile butyl rubber (NBR), or it may be a felt.

It may also be made of a material that is not compressible, e.g. a sintered material, for example sintered polyethylene, PVC, ethylene vinyl acetate (EVA), polyamide, or brass.

In particular when the first applicator member comprises an optionally deformable material that is not porous, it may be pierced by at least one orifice allowing substance to pass therethrough.

On the outside, the first applicator member may include a skin made of an impermeable material pierced by at least one orifice allowing the first substance to pass therethrough.

The application surface of the first applicator member may also be defined, for example, by woven or non-woven cloth, a screen, or leather.

The first applicator member may comprise a plurality of layers of different kinds.

The above-mentioned housing may be formed in various ways.

By way of example, the closure capsule may comprise at least one lid suitable for occupying a closed position in which it closes the housing, and an open position in which it gives access to the housing.

The lid may optionally be connected to the remainder of the closure capsule when in the open position. When the lid is connected to the remainder of the closure capsule in the open position, this may be achieved, for example, by means of a film or other hinge. The lid may optionally include a sealing lip, e.g. depending on the nature of the substance.

As mentioned above, the housing may be defined by a removable portion of the capsule.

This removable portion may comprise a body suitable for being releasably fixed on a base portion of the capsule and a lid that is movable relative to said body, e.g. being connected thereto by a hinge, and in particular a film hinge.

The lid and the body of the removable portion may be configured in such a manner as to be capable of closing the housing in substantially leaktight manner.

The body of the removable portion may be fixed on the base portion of the capsule in various different ways, e.g. by snap-fastening, by screw engagement, or by friction.

Depending on the desired appearance, the removable portion of the capsule may be made of a material and/or with a color differing from the material and/or color of the base portion of the capsule.

The closure capsule may include a mirror, e.g. carried by its lid.

The capsule may include at least one sealing lip suitable for co-operating with the receptacle in such a manner as to close it in substantially leaktight manner.

When the receptacle receives a substance, which substance may be in powder form, for example, the substance may, for example, be in optionally-compacted powder form, a cream, or a gel, and it may optionally include solid bodies such as flakes and/or pigment, e.g. mother of pearl.

The first and second substances respectively contained in the receptacle and in the housing may be complementary, i.e. they may be intended for depositing simultaneously or in succession on the same treated region.

The color of the second substance may be different from that of the first substance.

One of the two substances may be a cosmetic or a care product, and the other substance may be intended to modify the color and/or the texture of the first substance in such a manner as to match its color to a skin color or to a particular makeup effect, for example.

The second substance may be put into place in the housing, for example by being poured into it or by being present in a cup or a receptacle which is itself engaged at least in part in the housing.

In an embodiment of the invention, the housing may also receive a second applicator member, which member may comprise, for example, an optionally-flocked foam, a woven or non-woven cloth, or a brush, this list not being limiting.

By way of example, the receptacle may include a wall that is deformable, optionally having shape memory.

The receptacle need not be of variable volume, the application surface being fed with substance by capillarity and/or by gravity, for example, possibly by turning the receptacle upside-down.

Where appropriate, the receptacle may also carry a pump or a valve.

The closure capsule may include at least one portion that is transparent, or it may be made entirely out of transparent material. This can make it possible, for example, to be aware of the nature and/or the color of the substance contained in the housing of the closure capsule even when the housing is closed.

The capsule may be made optionally as a single piece, e.g. of plastics material.

The closure capsule may include a plurality of housings that are superposable.

By way of example, the closure capsule may comprise a stack of containers connected to one another by hinges.

By way of example, the hinges may be angularly offset around a stacking axis for the containers.

In another of its aspects, the invention also provides a method of applying a composition, in particular a cosmetic or a care product, e.g. on the skin, the method comprising the following steps:

using an application surface secured to a receptacle containing a first substance to take a second substance contained in at least one housing of a closure capsule of said receptacle, the second substance being taken while the capsule is separated from the receptacle; and applying said second substance on an individual.

In another of its aspects, the invention also provides a method of applying a composition, in particular a cosmetic or a care product, e.g. on the skin, the method comprising the following steps:

taking a substance contained in a housing of a closure capsule configured to be capable of being removably fixed on a receptacle containing a different substance, an applicator member being disposed on the receptacle, said applicator member being present at least in part inside an inside space of the capsule when the capsule is in place on the receptacle.

The substance can be taken, as mentioned above, without passing through the inside space of the capsule receiving the applicator member disposed on the receptacle. For example the substance may be taken by means of a finger or of an applicator while the closure capsule is in place on the receptacle.

In another of its aspects, the invention also provides a method of forming a personalized packaging and dispenser device, the method comprising the following steps:

providing a receptacle containing a first substance;

making a selection from a set of closure capsule or of removable portions of closure capsules, each containing a second substance different from the first substance and/or an applicator member; and assembling a selected closure capsule with the receptacle or fitting a selected removable portion on a base portion of the closure capsule, and where appropriate putting the assembly into place on the receptacle.

BRIEF DESCRIPTION OF THE DRAWINGS

The invention will be better understood on reading the following detailed description of non-limiting embodiments, and on examining the accompanying drawings, in which:

FIGS. 8 and 9 are diagrams showing variant embodiments of the closure capsule in which the closure capsule includes a removable portion;

FIGS. 10 to 12 are diagrammatic fragmentary views showing variant embodiments of the invention;

FIGS. 26 and 27 are diagrammatic views respectively in elevation and in plan view showing another device made in accordance with the invention, together with a closure capsule having a removable portion; and FIG. 28 is a view analogous to FIG. 26, showing a variant of the closure capsule without a removable portion.

DETAILED DESCRIPTION OF PREFERRED EMBODIMENTS

Figure 1:
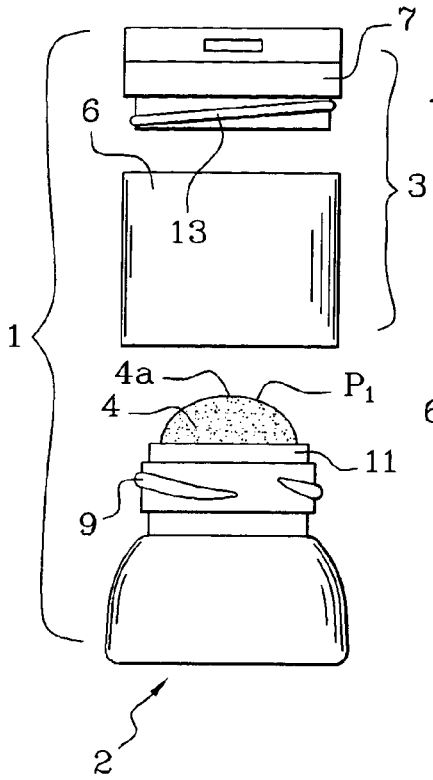
FIG. 1 is an exploded diagrammatic elevation view of a packaging and dispenser device constituting an embodiment of the invention.
Figure 2:
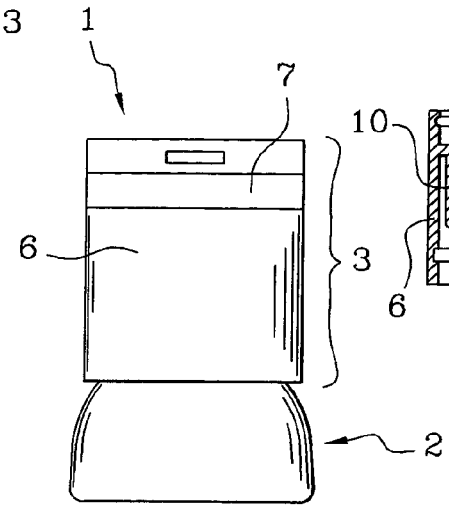
FIG. 2 shows the FIG. 1 device after the closure capsule has been assembled onto the receptacle.

FIGS. 1 and 2 show a device 1 comprising a receptacle 2 and a closure capsule 3 suitable for fixing in removable manner on the receptacle 2.

In the example shown, an applicator member 4 is fixed on the receptacle 2 in such a manner as to be fed with a substance $P_1$ contained in a housing of the receptacle, so that the substance $P_1$ can be present on the outside surface of the applicator member 4 which defines an application surface 4*a*. The closure capsule 3 closes the housing of the receptacle containing the substance $P_1$.

By way of example, the receptacle 2 may present a deformable wall, e.g. a wall having shape memory, thus enabling its inside volume to be squeezed so as to cause the substance to move towards the application surface 4*a*.

By way of example, the applicator member 4 may comprise a block of open-celled foam or a sintered piece. Other applicator members can also be used without going beyond the ambit of the present invention, and as described below.

The closure capsule 3 comprises a base portion 6 and a removable portion 7 which can also be referred to as a "satellite".

Figure 3:
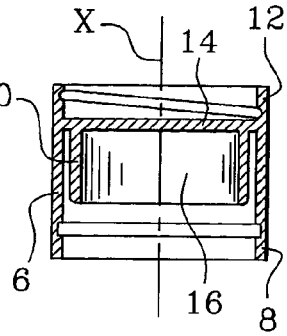
FIG. 3 is a diagrammatic axial section view of the bottom portion of the closure capsule of the device shown in FIGS. 1 and 2.

FIG. 3 shows the base portion 6 in isolation and in axial section.

It can be seen that it comprises a first skirt 8 that is tubular about an axis X and configured for screwing onto a thread 9 of the receptacle 2, together with a coaxial annular sealing lip 10 configured to press in leaktight manner against a surface of the neck 11 of the receptacle 2, so as to close the housing containing the substance $P_1$.

The base portion 6 has a transverse wall 14 to which the skirt 8 and the sealing lip 10 are connected.

Above the transverse wall 14, a second skirt 12 extends the first skirt 8 so as to allow the removable portion 7 to be fixed on the base portion 6.

In the example shown, this second skirt 12 has an inside thread for cooperating with a corresponding thread 13 made on the removable portion 7.

In the example shown, the removable portion is a male piece cooperating with the second skirt 12 which constitutes a female piece. Such a configuration may enable to provide in the removable portion a larger capacity.

However, it does not go beyond the scope of the invention when the removable portion constitutes a female piece able to cooperate with a male portion of the base portion.

Together with the transverse wall 14, the first skirt 8 defines an inside space 16 into which the receptacle 2 can penetrate, at least in part, and into which the applicator member 4 can penetrate in particular when the closure capsule 3 is assembled on the receptacle.

Figure 4:
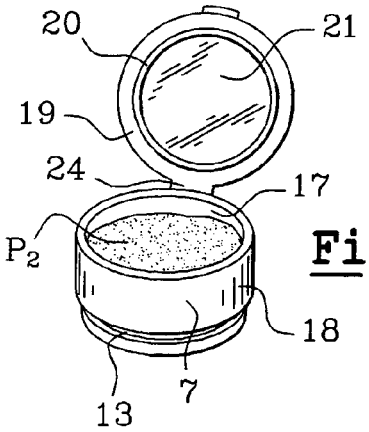
FIG. 4 is a diagrammatic perspective view showing the removable portion of the closure capsule of the device shown in FIGS. 1 and 2 in isolation.

FIG. 4 shows the removable portion 7 in isolation after being separated from the base portion 6.

In the example shown, the removable portion 7 comprises both a body 18 defining a housing 17 and a lid 19.

In the example shown, the housing 17 contains a substance $P_2$ different from the substance $P_1$.

The lid 19 may include an annular sealing lip 20 for pressing against the inside surface of the body 18 when the lid 19 is closed, and possibly also a mirror 21.

In the example shown, the lid 19 is connected to the body 18 via a hinge 24, which may be a film hinge, for example.

Naturally, the hinge 24 may be made other than as a film hinge.

Figure 5:
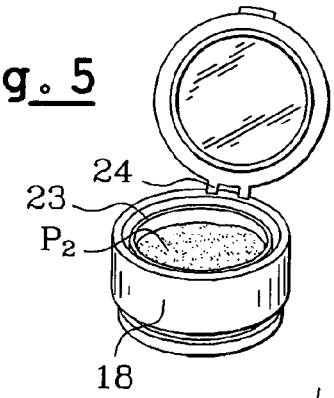
FIG. 5 is a view analogous to FIG. 4 showing a variant embodiment of the removable portion.

In the variant embodiment shown in FIG. 5, the substance $P_2$ is contained in a cup 23 placed inside the body 18.

By way of example, the first substance $P_1$ may be a liquid foundation and the substance $P_2$ may be a composition including flakes or pigments such as mother of pearl, which would find it difficult to reach the application surface 4*a* if contained in the receptacle 2 and needing to pass through the applicator member 4.

Figure 6:
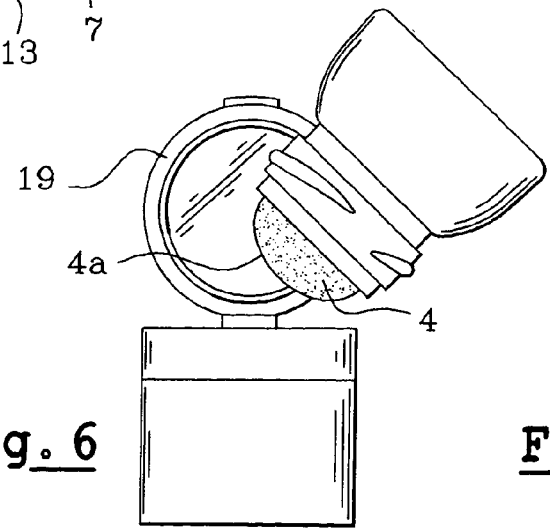
FIGS. 6 and 7 show two ways amongst others in which the substance contained in the housing of the closure capsule can be taken.

In order to use the device 1, the user can unscrew the closure capsule 3 and use the application surface 4*a* to take the substance $P_2$ from the housing 17 inside the body 18, after opening the lid 19, as shown in FIG. 6.

The user can easily load the applicator member 4 as described with the substance $P_2$ in order to obtain the desired makeup result.

The device 1 is particularly suitable for applying two complementary substances $P_1$ and $P_2$ suitable for being used simultaneously or successively in varying proportions.

In particular, the substance $P_2$ may be colored and the applicator member 4 can be used to take just the quantity required for obtaining the desired shade of color.

When the substance $P_2$ is a substance whose consistency prevents it from penetrating deeply into the applicator member 4, the substance $P_2$ taken by the applicator member 4 can easily be removed, e.g. by washing or by making contact with the skin or with a cleaning member, and this presents an advantage when the same applicator member 4 is intended for use with successive substances $P_2$ having different colors.

Figure 7:
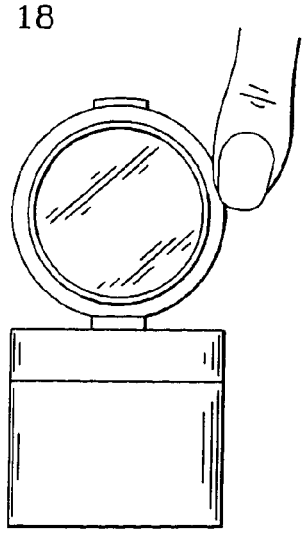

In a variant embodiment of the invention, the substance $P_2$ is not taken by means of the applicator member 4, but by means of some other applicator member or with a finger, as shown in FIG. 7.

Taking the substance by means of another applicator member or using a finger can serve to avoid depositing the substance $P_2$ on the applicator member 4.

The closure capsule 3 can comprise a base portion 6 and a removable portion 7 that are assembled together other than by screw fastening.

By way of example, FIG. 8 shows a variant embodiment in which the base portion 6 and the removable portion 7 have portions in relief 26 and 27 that are configured to co-operate by snap-fastening. By way of example, the removable portion 7 has a circular groove 27 and the base portion 6 has a corresponding bead 26. The base portions 6 and the removable portion 7 could also co-operate by friction.

Without going beyond the ambit of the present invention, it is possible to modify the shape of the removable portion 7, and in particular to make it with a lid 19 that is separable from the body 18, e.g. a lid 19 configured to screw onto a thread 30 of the body 18, as shown in FIG. 9.

Without going beyond the ambit of the present invention, the receptacle 2 may also comprise a pressurized enclosure 31, e.g. as shown in FIG. 10, the application surface 4*a* being fed with a substance contained in the enclosure 31 by means of a valve 32, for example. By way of example, the valve may be actuated by moving a support 33 relative to the enclosure 31, the support 33 having the applicator member 4 fixed thereon. The closure capsule 3 may then be configured so as to be fixed in removable manner, e.g. by snap-fastening, on the support 33. In a variant, a pump can be used.

It would not go beyond the ambit of the present invention for the application surface 4*a* not to be secured to the receptacle 2, but for it to be secured, for example, to the closure capsule 3, as shown in FIG. 11.

In this embodiment, the application surface 4*a* is defined by the bristles 4 of a brush used for applying nail varnish, these bristles being supported by a stem 50.

The closure capsule 3 has a base portion 6 configured so as to be capable of being screwed onto the receptacle 2, and it has a removable portion 7 including a housing 17.

By way of example, the removable portion 7 is fixed by snap-fastening on the base portion 6, to which the stem 50 is connected.

The housing 17 contains a substance $P_2$ and can be closed by a lid 19, the lid being connected to the remainder of the removable portion by means of a film hinge 24, for example.

It would not go beyond the ambit of the present invention for the first substance $P_1$ to be in the form of a relatively solid block. Under such circumstances, the application surface 4*a* could be defined by a portion of the outside surface of said block of substance.

By way of example, FIG. 12 shows a lipstick in the extended position defining an application surface 4*a* and carried by a receptacle 2 constituted by a lipstick case mechanism.

The receptacle may be closed by a capsule 3 which comprises a removable portion 7 and a base portion 6.

In a variant embodiment of the invention, the housing 17 need not contain a substance, but may instead contain a second applicator member, possibly already loaded with a substance different from the substance contained in the receptacle 2.

Figure 13:
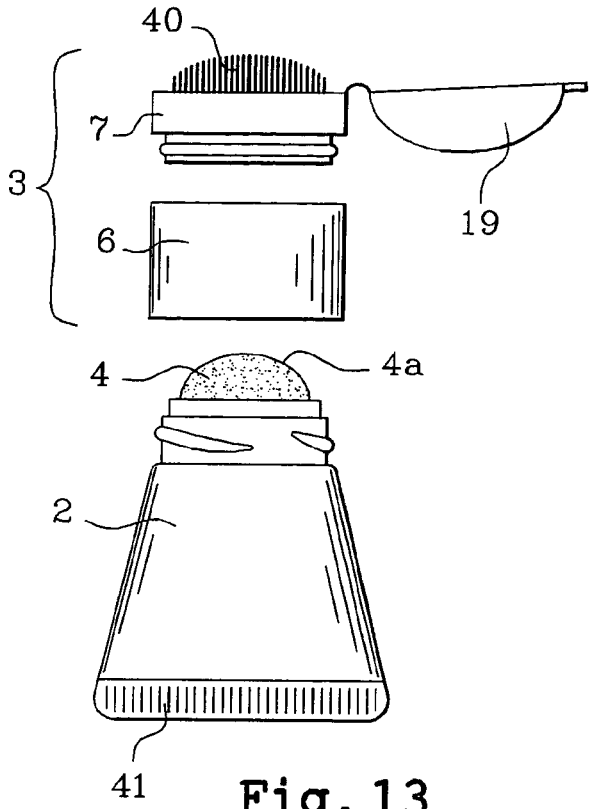
FIG. 13 is a diagrammatic exploded view of a packaging and dispenser device made in accordance with another embodiment of the invention.
Figure 14:
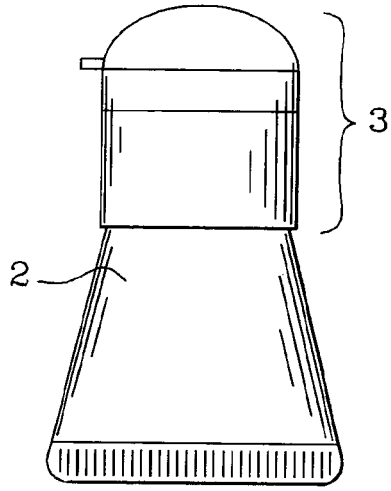
FIG. 14 shows the FIG. 13 device with the closure capsule in place.

In the example of FIGS. 13 and 14, the removable portion 7 includes an applicator member 40, e.g. in the form of a brush, and suitable for fixing in optionally permanent manner on the removable portion 7.

In these figures, it can be seen that the lid 19 may be configured in such a manner as to match the outside shape of the applicator member 40.

It can also be seen that the receptacle 2 may comprise a tube having a bottom end 41 heat-sealed thereto, for example.

The second applicator member 40 may be used for applying the substance contained in the receptacle 2, e.g. for finishing purposes, optionally after previous use of the first applicator member 4.

The applicator member 40 may also be loaded with a second substance and the applicator member 4 may be brought into contact with the applicator member 40 in order to pick up the substance present on the applicator member 40.

Naturally, various applicator members 40 can be used without going beyond the ambit of the present invention.

Figure 15:
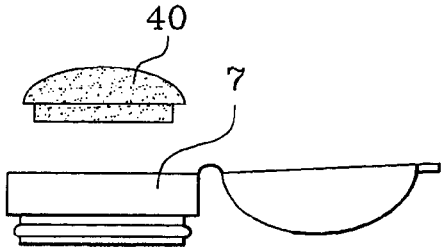
FIGS. 15, 16, and 17 show variant applicator members, FIGS. 15 and 16 relating to applicator members suitable for being contained in the housing of the removable portion and FIG. 17 to an applicator member secured to the receptacle.

As shown in FIG. 15, it is possible for example to use an applicator member 40 which is not permanently fixed to the removable portion 7 and which can be removed during application, or which can be removed and replaced.

Figure 16:
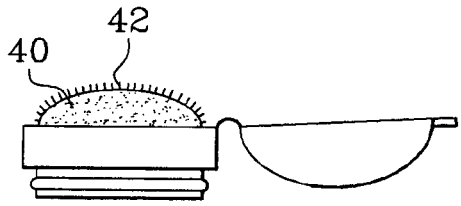

The applicator member 40 may comprise a foam, as is the case in the example of FIG. 15.

Where appropriate, the applicator member 40 may include flocking 42, as shown in FIG. 16.

Figure 17:
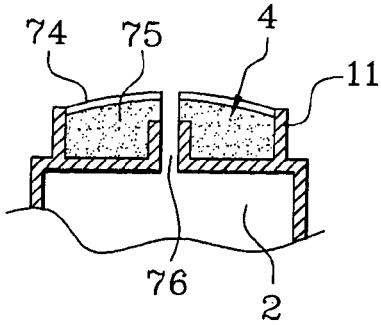

The applicator member 4 may present various shapes and natures. By way of illustration, FIG. 17 shows an applicator member 4 fixed in the neck 11 of the receptacle 2 and including a skin 74 which may be impermeable and which may cover a block 75 of compressible material, e.g. a foam. The skin is pierced by an orifice 76 allowing the substance to pass through.

The closure capsule may include either a substance or an applicator member.

Nevertheless, it can also be arranged otherwise, for example the closure capsule may include both a substance different from the substance contained in the receptacle 2 and at least one additional applicator member.

Figure 18:
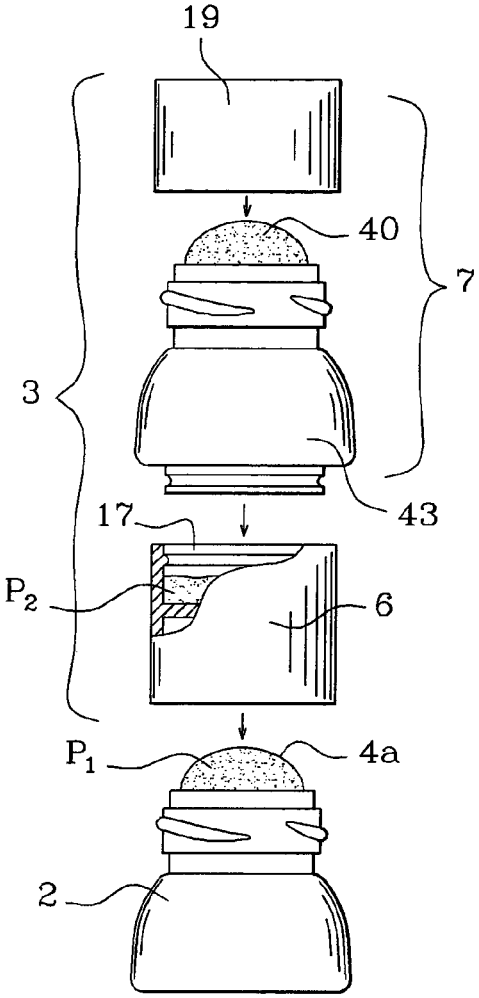
FIGS. 18 and 19 are exploded diagrammatic views of two other embodiments of the invention.
Figure 19:
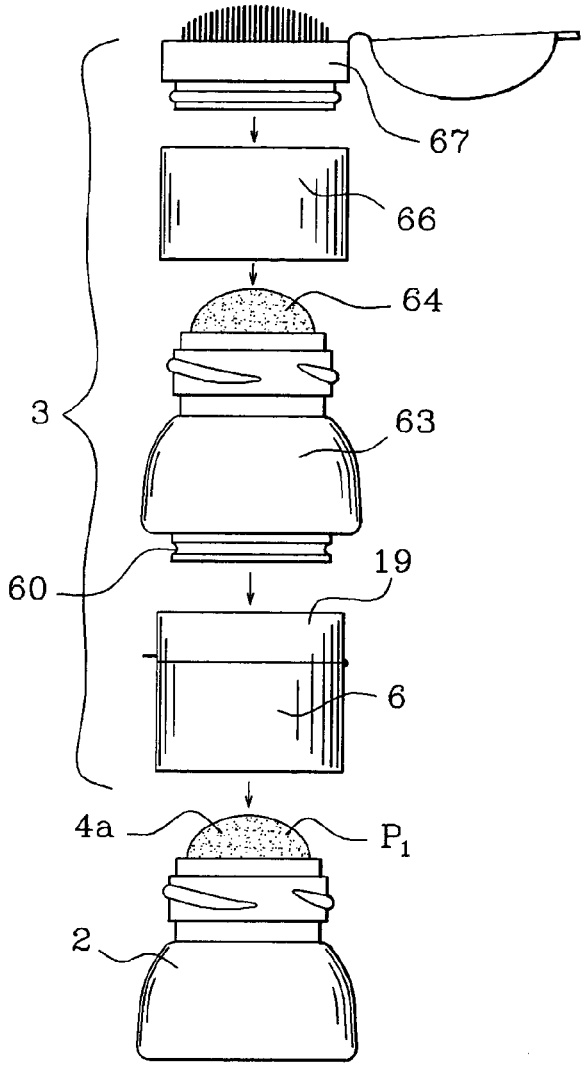

Examples are shown in FIGS. 18 and 19.

FIG. 18 shows that the removable portion 7 of the closure capsule can include an applicator member 40 optionally secured to a receptacle 43 containing a substance different from the substance contained in the receptacle 2. The receptacle 43 may be configured for fixing on the base portion of the closure capsule, e.g. having a bottom that is configured to be capable of being snap-fastened thereon. A closure lid 19 may be provided for fixing on the receptacle 43, e.g. by screw fastening.

The receptacle 43 may optionally be similar to the receptacle 2.

FIG. 18 shows that the base portion 6 can include a housing 17 containing a substance $P_2$, this housing being closed when the receptacle 43 is fixed on the base portion 6.

It would not go beyond the ambit of the present invention for the closure capsule 3 to include more than one applicator member.

By way of example, FIG. 19 shows a device comprising a receptacle 2 suitable for being closed by a capsule 3 comprising a base portion 6 and a housing suitable for being closed by a lid 19, which lid may, for example, be connected via a film hinge to the base portion 6. The housing can receive a substance or an applicator member. The lid 19 can be configured to enable a second receptacle 63 having fixing means 60 to be fixed thereto.

By way of example, the receptacle 63 includes an applicator member 64 and a closure capsule which, like the example described with reference to FIG. 13, can comprise a base portion 66 and a removable portion 67 in which an applicator member can be received.

It would not go beyond the ambit of the present invention for the closure capsule 3 not to include a removable portion, as described below with reference to FIG. 20.

This figure shows that the housing 17 can be defined by an annular wall 44 extending the first skirt 8, and by the transverse wall 14.

The housing 17 can be closed by a lid 19, like the embodiment shown in FIGS. 1 and 2, for example.

Figure 20:
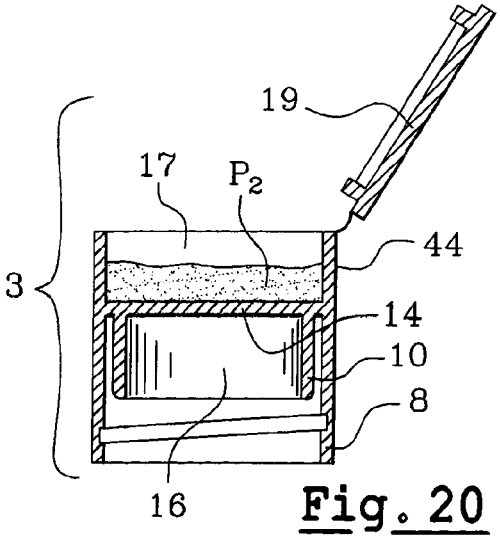
FIGS. 20 and 21 are diagrammatic axial sections showing variant embodiments of a closure capsule without a removable portion.

In the example of FIG. 20, the inside space 16 and the housing 17 are not in communication, such that when the closure capsule 3 is not in place on the receptacle 2 and the lid 19 is in its closed position, the housing 17 is closed in substantially leaktight manner and the substance $P_2$ contained therein can be conserved under good conditions.

Figure 21:
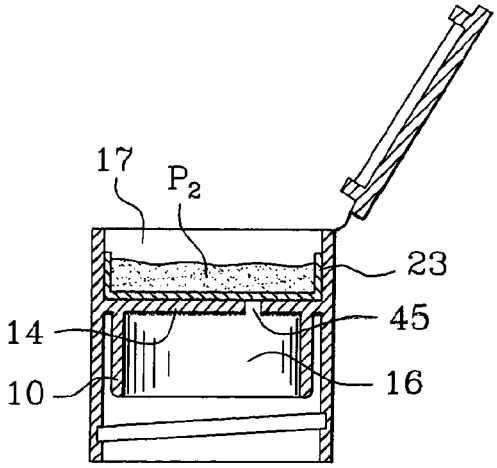
Figure 22:
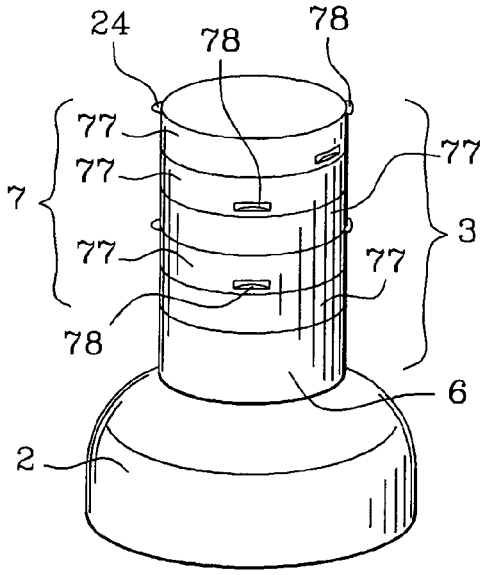
FIG. 22 is a diagrammatic perspective view of another embodiment of the invention in which the closure capsule has a plurality of housings.

In particular when the substance $P_2$ does not contain a volatile solvent, communication can be established between the inside space 16 and the housing 17, as shown in FIG. 21, e.g. by means of at least one orifice 45 passing through the transverse wall 14. FIG. 21 also shows that the substance $P_2$ may be contained in a cup 23, particularly under such circumstances.

It would not go beyond the ambit of the present invention for the closure capsule 3 to include a plurality of housings 17 each suitable for containing an applicator member or a substance.

By way of example, FIGS. 22 to 25 show a packaging and dispenser device comprising a receptacle 2 containing a first substance $P_1$, and a closure capsule 3 comprising a base portion 6 suitable for fixing on the receptacle 2 in order to close it, together with a removable portion 7 comprising a plurality of superposable housings 17.

Each housing 17 is formed by a cup-shaped container 77.

With the exception of the container 77 which is fixed on the base portion 6, each other container 77 is fixed on the closure lid of the container immediately beneath it, or is configured to act as the lid of the container immediately beneath it.

When a container is configured to form the lid of the immediately preceding container, the bottom wall of the container may include a sealing lip 20 on its bottom face configured to fit in leaktight manner on the container immediately beneath it.

Each lip 20 may further comprises a bead 20*a* projecting from its radially outer surface for snap-fastening in a corresponding groove formed in the container immediately beneath it.

When a container 77 is used as a lid for the container immediately beneath it, the two containers may be connected to each other by means of a hinge, e.g. a film hinge 24.

When each container 77 has its own lid, and with the exception of the container 77 furthest from the receptacle 2, the container immediately above it is fixed to said lid, and each lid can be connected to the corresponding container by a hinge 24, e.g. a film hinge.

As shown in the figures, each container may also include a tab 78 diametrically opposite from the hinge 24, making it easier to open the corresponding housing.

In the example shown, it can be seen that the hinges 24 need not be superposed when the device is seen in plan view, but can instead be angularly offset around the stacking axis of the containers 77.

The housings 17 may contain different substances, for example substances of different colors.

The user can open the column made up of the stack of containers 77 at the level corresponding to the selected substance.

Figure 24:
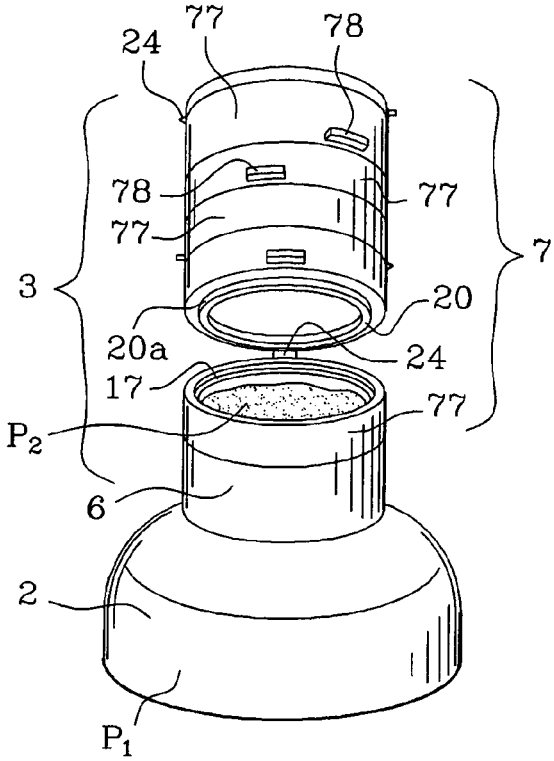
FIGS. 24 and 25 show how it is possible to access different housings of the closure capsule.
Figure 25:
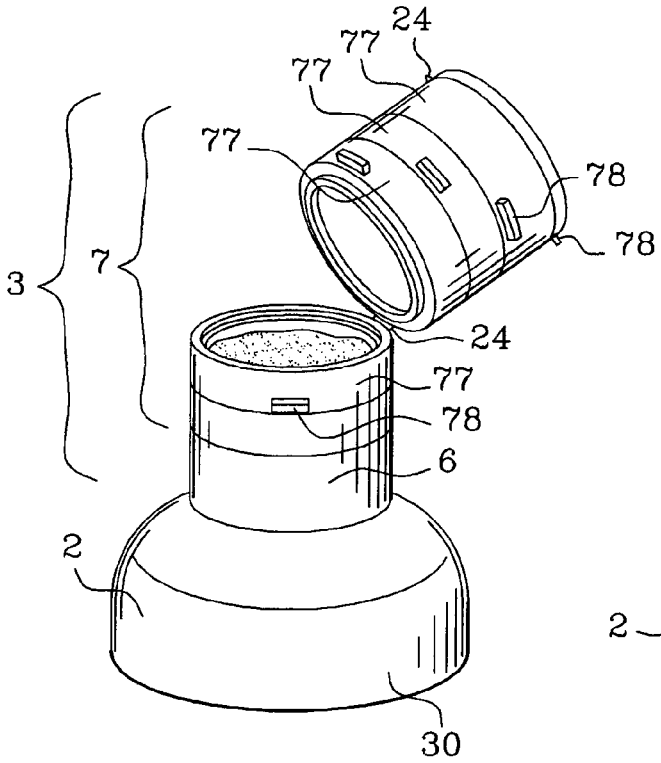
Figure 23:
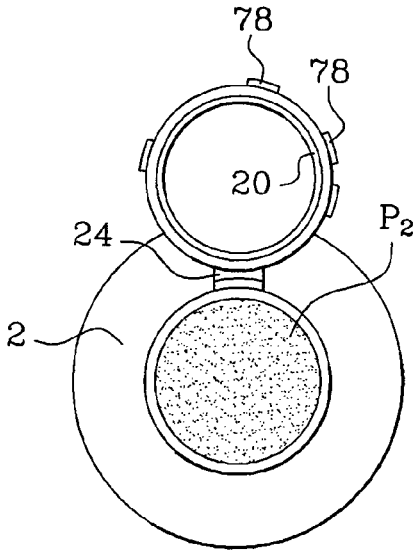
FIG. 23 is a plan view of the FIG. 22 device after a housing has been opened.

In the example of FIG. 24, the user has opened the column to gain access to the first container starting from the bottom, whereas in the example of FIG. 25, it can be seen that the user has selected to gain access to the second container starting from the bottom.

The presence of hinges 24 between the containers makes it possible to avoid any need to put a piece down while the device is in use and enables the closure capsule to be handled using one hand only.

The closure capsule 3 comprising a plurality of containers 77 can be associated with different types of receptacle, for example a tube 2 whose bottom end is heat-sealed thereto, as shown in FIG. 26.

In this figure, the closure capsule 3 has a base portion 6 and three containers 77 interconnected by hinges 24 that are angularly offset around the stacking axis.

As shown, the hinges used may comprise two connecting strips 24*a*, 24*c* together with a resilient strip 24*b* situated between the connecting strips, the resilient strip 24*b* being configured to deform elastically when the hinge is opened so as to pass through a state of maximum stress prior to reaching the maximum degree of opening, thereby contributing to holding the hinge in the open position with an open angle that is large enough to provide easy access to the content of the corresponding housing.

Pairs of tabs 79 may be provided to make it easier to open the containers, as in the example shown.

Each pair of tabs may comprise one tab 79*a* secured to the body of a container 77 and another tab 79*b* secured to the body of the container immediately above it, or to a lid in the case of the last container 77.

Each tab 79*b* may be made by extending a lid hinged on the container. With the exception of the bottom container, each container 77 may be fixed to the top face of the lid associated with the container immediately beneath it, e.g. by adhesive or by heat-sealing.

In the examples of FIGS. 22 to 27, the container 77 adjacent to the base portion 6 is removably fixed thereto.

It would not go beyond the ambit of the present invention for the body of the bottom container to be made integrally with the base portion 6, i.e. for it not to be removably connected thereto, as shown in FIG. 28.

Naturally, the invention is not limited to the embodiments described above.

For a given receptacle 2, it is possible in particular to provide a plurality of different closure capsules 3, e.g. containing different substances and/or different applicator members, with the user being free to associate a selected closure capsule with the receptacle, for example depending on the desired makeup result.

A single base portion 6 may likewise be associated with a removable portion 7 selected amongst a plurality of removable portions, with the user making such a selection as a function of the substance or the applicator the user desires to use.

Throughout the description, including in the claims, the term "comprising a" should be understood as being synonymous with "comprising at least one", unless the contrary is specified.

The characteristics of the various embodiments may be combined with one another.

What is claimed is:

1. A packaging and dispenser device comprising:

a receptacle containing a first substance;

an application surface secured to the receptacle during application of the first substance; and a closure capsule of the receptacle containing the first substance, configured to be removably fixed on the receptacle, said closure capsule comprising:

fixing means for enabling the closure capsule to be fixed on the receptacle; and at least one housing containing a second substance, said housing being configured so that the second substance can be withdrawn through an opening at an end of the capsule remote from the fixing means, the housing being configured to remain linked to the fixing means during the withdrawn of the second substance, and wherein the first substance is one of the lipstick, nail varnish, foundation, powder, gel, and care cream, the second substance is one of a cosmetic product and a care product, and the application suface is configured for applying the first substance on at least one of the nails, skin, lips eyebrows or eyelashes.

2. A device according to claim 1, wherein said capsule includes a removable portion and a base portion and wherein at least one housing is defined by a removable portion of the capsule.

3. A device according to claim 2, wherein the removable portion includes at least one applicator member.

4. A device according to claim 2, wherein the removable portion of the capsule is made of a material and/or with a color different from the material and/or the color of the base portion of the capsule.

5. A device according to claim 2, wherein the removable portion comprises at least one body, together with a lid movable relative to the body.

6. A device according to claim 5, wherein the lid and the body are configured in such a manner as to be able to close said at least one housing in substantially leaktight manner.

7. A device according to claim 5, wherein the body of the removable portion is fixed on the base portion of the capsule by snap-fastening, by screw fastening, or by friction.

8. A device according to claim 1, wherein the first substance is a cosmetic or a care product.

9. A device according to claim 1, wherein the first substance is in the form of a solid block.

10. A device according to claim 9, wherein the application surface is constituted by at least a portion of the surface of said block.

11. A device according to claim 1, wherein the application surface is defined by a first applicator member.

12. A device according to claim 11, wherein the first applicator member is engaged at least in part in an inside space of the closure capsule when the capsule closes the receptacle.

13. A device according to claim 11, wherein the first applicator member comprises a non-porous material.

14. A device according to claim 13, wherein the first applicator member is pierced by at least one orifice allowing the first substance to pass therethrough.

15. A device according to claim 11, wherein the first applicator member is porous.

16. A device according to claim 15, wherein the first applicator member comprises a foam.

17. A device according to claim 11, wherein the first applicator member comprises a compressible material.

18. A device according to claim 11, wherein the first applicator member includes, on the outside, a skin made of an impermeable material, said skin being pierced by at least one orifice allowing the first substance to pass therethrough.

19. A device according to claim 11, wherein the application surface is defined by a woven or non-woven cloth, a screen, or leather.

20. A device according to claim 11, wherein the first applicator member comprises a plurality of layers of different kinds.

21. A device according to claim 1, wherein the closure capsule includes at least one lid capable of taking up a closed position in which it closes said at least one housing, and an open position in which it gives access to the housing.

22. A device according to claim 21, wherein, while the lid is in its open position it is connected to the remainder of the closure capsule by a hinge.

23. A device according to claim 1, wherein the closure capsule includes a plurality of superposable housings.

24. A device according to claim 1, wherein the closure capsule comprises a stack of containers interconnected by hinges.

25. A device according to claim 24, wherein the hinges are angularly offset around a stacking axis of the containers.

26. A device according to claim 1, wherein the capsule is configured to be fixed on the receptacle by screw fastening, snap-fastening, or friction.

27. A device according to claim 1, wherein the capsule is made as a single piece of plastics material.

28. A device according to claim 1, wherein the closure capsule is configured to enable leak-tight closure of the housing containing the first substance.

29. A device according to claim 1, wherein the closure capsule is configured to isolate from the outside the application surface when the capsule is in place on the receptacle.

30. A device according to claim 1, wherein said at least one housing contains a second substance complementary to the first.

31. A device according to claim 1, wherein the closure capsule includes a mirror.

32. A packaging and dispenser device comprising:

a receptacle containing a first substance;

a closure capsule configured to be fixed in removable manner on the receptacle;

an application surface suitable for being contained in an assembly formed by the receptacle and the closure capsule when the receptacle is closed by the closure capsule; and at least one housing defined by a removable portion of the capsule, said removable portion being capable of being fixed on a base portion of the capsule, the closure capsule being configured to enable the housing to be opened independently of fixing the removable portion on the base portion, the housing being suitable for containing at least part of an applicator member and/or a second substance, the housing being configured to remain linked to the base portion during withdrawn of the application member and/or the second substance, and wherein the first substance is one of lipstick, nail varnish, foundation, powder, gel, and care cream, the second substance is one of a cosmetic product and a care product, and the application surface is configured for applying the first substance on at least one of nails, skin, lips eyebrows or eyelashes.

33. A device according to claim 32, wherein the removable portion includes at least one applicator member.

34. A device according to claim 32, wherein the removable portion of the capsule is made of a material and/or with a color different from the material and/or the color of the base portion.

35. A device according to claim 32, wherein the removable portion comprises at least one body, together with a lid movable relative to the body.

36. A device according to claim 35, wherein the lid and the body are configured in such a manner as to be able to close said at least one housing in substantially leaktight manner.

37. A device according to claim 35, wherein the body of the removable portion is fixed on the base portion of the capsule by snap-fastening, by screw fastening, or by friction.

38. A device according to claim 32, wherein the first substance is a cosmetic or a care product.

39. A device according to claim 32, wherein the first substance is in the form of a solid block.

40. A device according to claim 39, wherein the application surface is constituted by at least a portion of the surface of said block.

41. A device according to claim 32, wherein the application surface is defined by a first applicator member.

42. A device according to claim 41, wherein the first applicator member is engaged at least in part in an inside space of the closure capsule when the capsule closes the receptacle.

43. A device according to claim 41, wherein the first applicator member comprises a non-porous material.

44. A device according to claim 43, wherein the first applicator member comprises a foam.

45. A device according to claim 43, wherein the first applicator member is pierced by at least one orifice allowing the first substance to pass therethrough.

46. A device according to claim 41, wherein the first applicator member is porous.

47. A device according to claim 41, wherein the first applicator member comprises a compressible material.

48. A device according to claim 41, wherein the first applicator member includes, on the outside, a skin made of an impermeable material, said skin being pierced by at least one orifice allowing the first substance to pass therethrough.

49. A device according to claim 41, wherein the application surface is defined by a woven or non-woven cloth, a screen, or leather.

50. A device according to claim 41, wherein the first applicator member comprises a plurality of layers of different kinds.

51. A device according to claim 32, wherein the closure capsule includes at least one lid capable of taking up a closed position in which it closes said at least one housing, and an open position in which it gives access to the housing.

52. A device according to claim 51, wherein, while the lid is in its open position it is connected to the remainder of the closure capsule by a hinge.

53. A device according to claim 32, wherein the closure capsule includes a plurality of superposable housings.

54. A device according to claim 32, wherein the closure capsule comprises a stack of containers interconnected by hinges.

55. A device according to claim 54, wherein the hinges are angularly offset around a stacking axis of the containers.

56. A device according to claim 32, wherein the capsule is configured to be fixed on the receptacle by screw fastening, snap-fastening, or friction.

57. A device according to claim 32, wherein the closure capsule is configured to enable to close in leaktight manner the receptacle containing the first substance.

58. A device according to claim 32, wherein the closure capsule is configured to isolate from the outside the application surface when the capsule is in place on the receptacle.

59. A device according to claim 32, wherein the capsule is made as a single piece of plastics material.

60. A device according to claim 32, wherein said at least one housing contains a second substance complementary to the first.

61. A device according to claim 32, wherein the closure capsule includes a mirror.

62. A packaging and dispenser device comprising:

a receptacle containing a first substance;

an application surface secured to the receptacle during application of the first substance; and a closure capsule of the receptacle containing the first substance, configured at one end to be removably fixed on the receptacle, said closure capsule comprising at least one housing containing a second substance, said housing being configured so that the second substance can be withdrawn through an opening at an end of the capsule remote from the end removably fixed on the receptacle, the housing being configured to remain linked to the one end to be removably fixed on the receptacle during the withdrawn of the econd substance, and wherein the first substance is one od lipstick, nail varnish, foundation, powder, gel, and care cream, the second substance is one of a cosmetic product and a care product, and the application surface is configured for applying the first substance on at least one of nails, skin, lips eyesbrows and eyelashes.

63. A method of applying a composition comprising the following steps:

using the packaging and dispenser device according to claim 1, to take the second substance contained in the at least one housing of the closure capsule of said receptacle, the second substance being taken while the capsule is separated from the receptacle; and applying said second substance on an individual.

64. A method of making up a packaging and dispenser device that is personalized, the method comprising the following steps:

providing the packaging and dispenser device according to claim 1;

making a selection from a set of closure capsules of the receptacle containing the first substance or of removable portions of closure capsules from the receptacle containing the first substance, each containing a second substance different from the first substance and/or an applicator member; and assembling a selected closure capsule with the receptacle or fitting a selected removable portion on a base portion of the closure capsule.

* * * * *